US006729490B2

(12) United States Patent
Bylo

(10) Patent No.: US 6,729,490 B2
(45) Date of Patent: May 4, 2004

(54) MODULAR COMBAT LOAD SYSTEM

(75) Inventor: John Michael Bylo, Ventura, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/323,208

(22) Filed: Dec. 13, 2002

(65) Prior Publication Data

US 2003/0089712 A1 May 15, 2003

Related U.S. Application Data

(63) Continuation-in-part of application No. 09/983,044, filed on Oct. 17, 2001, now Pat. No. 6,494,336.

(51) Int. Cl.[7] ..... B65D 21/36

(52) U.S. Cl. ..... 220/23.88; 220/23.6; 220/23.89; 206/597

(58) Field of Search ..... 220/23.88, 23.6, 220/23.89, 23.56; 206/597

(56) References Cited

U.S. PATENT DOCUMENTS 2,010,812 A * 8/1935 Devine ..... 220/592.23
2,960,250 A * 11/1960 Haloski ..... 220/592.23
3,445,050 A * 5/1969 Friehe et al. ..... 220/23.88
4,195,728 A * 4/1980 Cardamone ..... 206/778
5,216,947 A * 6/1993 Cheng ..... 99/417
6,189,330 B1 * 2/2001 Retallick et al. ..... 62/371
6,209,725 B1 * 4/2001 Chen ..... 206/508

* cited by examiner

*Primary Examiner*—Joseph Man-Fu Moy
(74) *Attorney, Agent, or Firm*—David S. Kalmbaugh

(57) ABSTRACT

A modular combat load system which is man-portable, light weight and easily moved from one location to another and which allows the military to supply troops with mission critical consumable supplies, such as drinking water, in a combat environment. The system has sixteen modular combat load units stacked on a pallet. The modular combat load system may be a disposable modular combat load unit which includes a mission requirements unit load container designed to hold a plurality of individual disposable combat modular storage units of varying size. Each individual storage unit may be used for storage and transport of food, water, medical supplies, ammunition and other consumables used by military troops in a combat zone.

20 Claims, 10 Drawing Sheets

MODULAR COMBAT LOAD SYSTEM

This application is a continuation-in-part of U.S. patent application Ser. No. 09/983,044, filed Oct. 17, 2001 now U.S. Pat. No. 6,494,336.

BACKGROUND OF THE INVENTION

1. Field of the Invention

The present invention relates generally to a system for supplying the military with mission critical consumable supplies in a combat environment. More specifically, the present invention relates to a modular combat load system which is portable, light weight and is easily moved from one location to another location and which provides an efficient means for supplying the military with mission critical consumable supplies, such as drinking water, in a hostile or combat environment.

2. Description of the Prior Art

Currently, the supply of combat loads to military ground forces ashore is unique among supply scenarios in that it is driven by a time critical need for system responsiveness to unplanned material requests that are often emergency situations dealing with life and death. In particular, the timely re-supply of consumables to troops ashore is a unique requirement of the military when in a combat or hostile environment and is substantially different from standard assault logistics operations.

There is also a need for a modular combat load system which comprises a one-way disposable system which allows for standardized multi-product containers that will increase the through put, range capability of the combat service support function and improve the efficiency of the cargo delivery process.

The modular combat load system must allow for (1) a standard unit of distribution and unit of issue; (2) for a seamless flow of supplies from manufacturer to user; (3) provide for the different standard missions that the marines and other land based military personnel train for; and (4) allow for integration with existing logistic material movement handling equipment currently in use by the military.

SUMMARY OF THE INVENTION

The present invention overcomes some of the disadvantages of the past including those mentioned above in that it is a relatively simple in design yet offers a highly effective modular combat load man-portable system which when deployed will allow for the transport of mission critical consumable supplies, such as drinking water, to a hostile or combat environment that is beyond the reach of powered material handling equipment. This modular combat load system will then allow combat troops to carry out their mission in hostile or combat environment where conventional material handling equipment cannot operate.

The modular combat load system is portable, light weight and easily moved from one location to another location and also provides a means for the military to supply troops with mission critical consumable supplies, such as drinking water, rations, ammunition and medical supplies, in a wide range of combat environments. The system includes sixteen modular combat load units stacked on a 48 inch by 48 inch pallet. Each modular combat unit has a water/fuel module which comprises the upper portion of the unit, a mission requirements module which comprises the lower portion of the unit and a field pack module assembly which is positioned within a cavity formed within the interior of the mission requirements module. The field pack module assembly holds a plurality of field pack storage units which are stacked on top of one another within the tray.

The water/fuel module of each unit contains about 5.00 gallons of water and may be fabricated from a light weight, clear plastic or polymer. When used to carry fuel, the module is fabricated from a strong cross linked polymer which is opaque to light. The field pack storage units are of sufficient size to hold one day of consumable supplies for use by a soldier in a combat environment.

The interior of mission requirements module may be used to store additional medical supplies, food and water, ammunition and other consumables used by military troops in a combat area, or simply to serve as an extended field pack for a fire team consisting of four soldiers.

In an alternative embodiment, the present invention may comprise a disposable modular combat load unit for transport and storage of fuel, medical supplies, food and water, ammunition and other consumables used by military troops in a combat area. The disposable modular combat load unit is environmentally friendly in that the unit is degradable over time or can be recycled to produce other paper products. The disposable modular combat load unit includes a mission requirements module which is designed to hold a plurality of individual disposable combat modular storage units of varying size.

In addition, the disposable modular combat load unit includes a water/fuel module which is designed to fit within an individual disposable combat modular storage unit for transport to a combat zone. The water/fuel module may be fabricated from a light weight, clear plastic or polymer when the module is used to transport water to a combat environment. When used to carry fuel, the module is generally fabricated from a polymer which is opaque to light double walled, and which is designed for fuel transport.

Sixteen of the disposable modular combat load units may be loaded onto a standard 48"×48" pallet for transport by a vehicle to a combat zone.

DETAILED DESCRIPTION OF THE PREFERRED EMBODIMENTS

Figure 1:
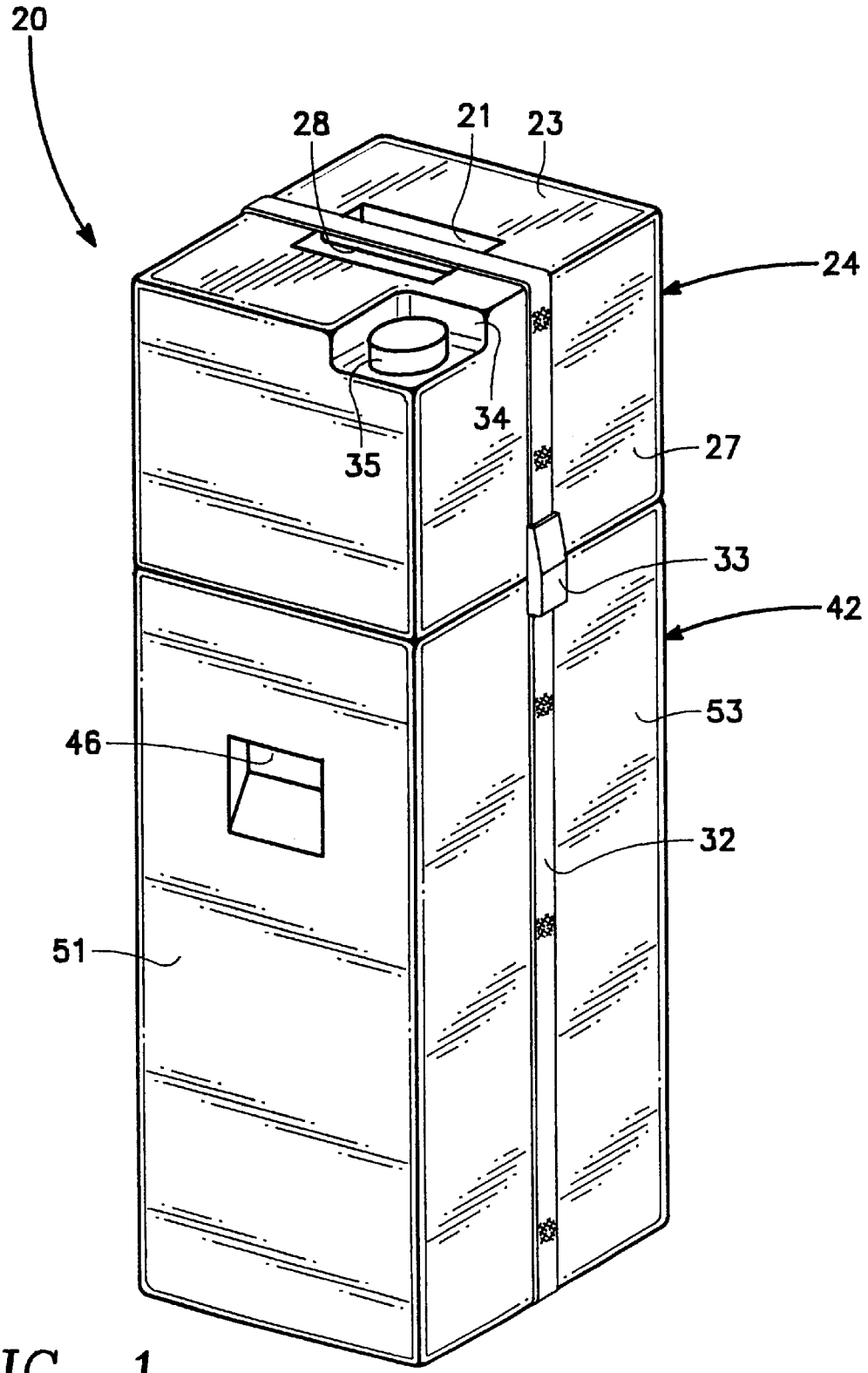
FIG. 1 is a perspective view illustrating a modular combat load unit for storing consumable products for use by a soldier in a combat environment which constitutes a preferred embodiment of the present invention.
Figure 2:
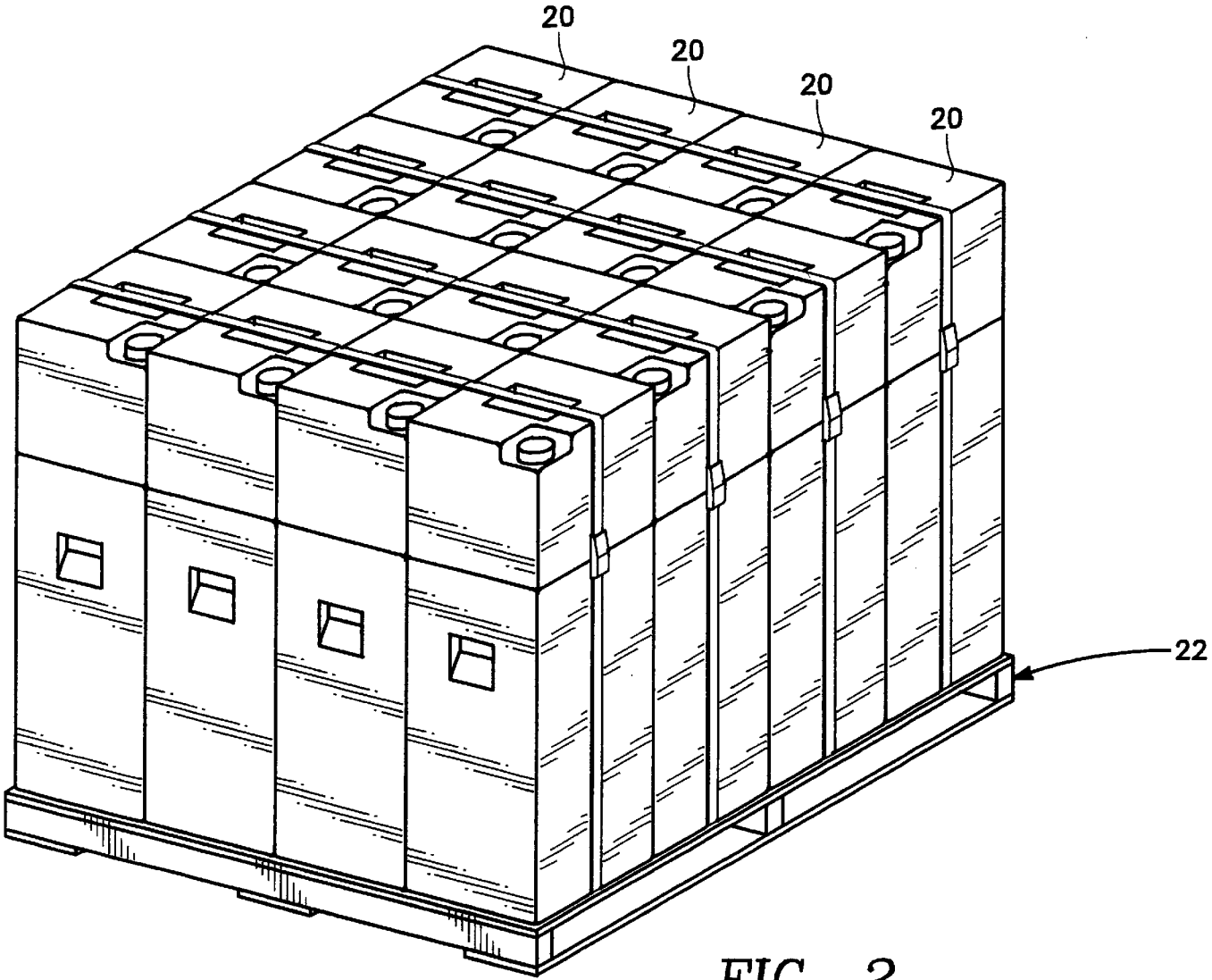
FIG. 2 illustrates a pallet upon which sixteen modular combat load units of the type shown in FIG. 1 are stacked.

Referring first to FIGS. 1 and 2, there are shown sixteen modular combat load units 20 stacked on a pallet 22 for use by a squad of marines, army or other United States combat troops in a hostile or combat environment. The pallet 22 upon which the load units 20 are stacked has dimensions of 48 inches long by 48 inches wide by 42 inches high. The pallet 22 supports a weight of 4000 lbs. and a volume of 56 cubic feet.

Each modular combat load unit 20 is designed for an individual soldier and mission supply requirements within a squad and provides the required consumable products for the individual for one day of operations in a hostile or combat environment. Each modular combat unit 20 has overall dimensions of 12 inches long by 12 inches wide by 42 inches high and an approximate weight of 170.00 lbs. which allows for a universally transportable logistics supply load on a pallet ready for direct delivery to a battle front by air delivery from a sea base.

Referring to FIGS. 1, 3, 4 and 5, the modular combat load unit 20 includes a water/fuel module 24 positioned at the upper end of the unit 20. When used to carry water, the water/fuel module 24 of each unit 20 contains about 5.00 gallons of water at a weight of 31.5 lbs and may be fabricated from a light weight, clear plastic or polymer. When used to carry fuel, module 24 is fabricated from a polymer which is opaque to light. The overall dimensions of water/fuel module 24 are 12 inches long by 12 inches wide by 12 inches high.

Module 24 has a generally rectangular shaped wash basin 26 formed within the interior of module 24 in the lower half of module 24. Wash basin 26 has a depth of about five inches and allows a soldier, for example, to wash and clean small wounds which occur in a combat environment. The cavity 29 between wash basin 26 and the upper end 23 of water module 24 is used for storage of water or fuel.

The width of wash basin 26 is about 8.125 inches. Positioned within a recess 21 on the top or upper end 23 of water module 24 is a centrally located handle 28 which is integrally formed within module 24. Handle 28 allows a user of module to transport module 24 from one location to another location when module 24 is separated from modular combat load unit 20.

Module 24 includes a centrally located one eight inch indent 30 which is adapted to receive a channel strap 32. Indent 30 runs across the top or upper end 23 of module 24 and is vertically positioned on opposite side walls 25 and 27 of module 24. Channel strap 32, which includes a buckle assembly 33, fits within indent 30 and is used to secure the module 24 to a mission requirements module 42.

Located in one corner of the top 23 of module 24 is a generally rectangular shaped recess 34 which has a cylindrical shaped threaded member/cap 35 and its associated threaded orifice 36 extending vertically upward from recess 34. Threaded member 36, which includes 6 threads/inch on its outer surface, is adapted to receive a spout and cap assembly which includes a retractable spout 37. The retractable spout 37 allows a user to transfer fuel from the cavity 29 of module 24 to a jeep, light armored vehicle, truck, HHWV or other military vehicle used in a combat area.

Figure 3:
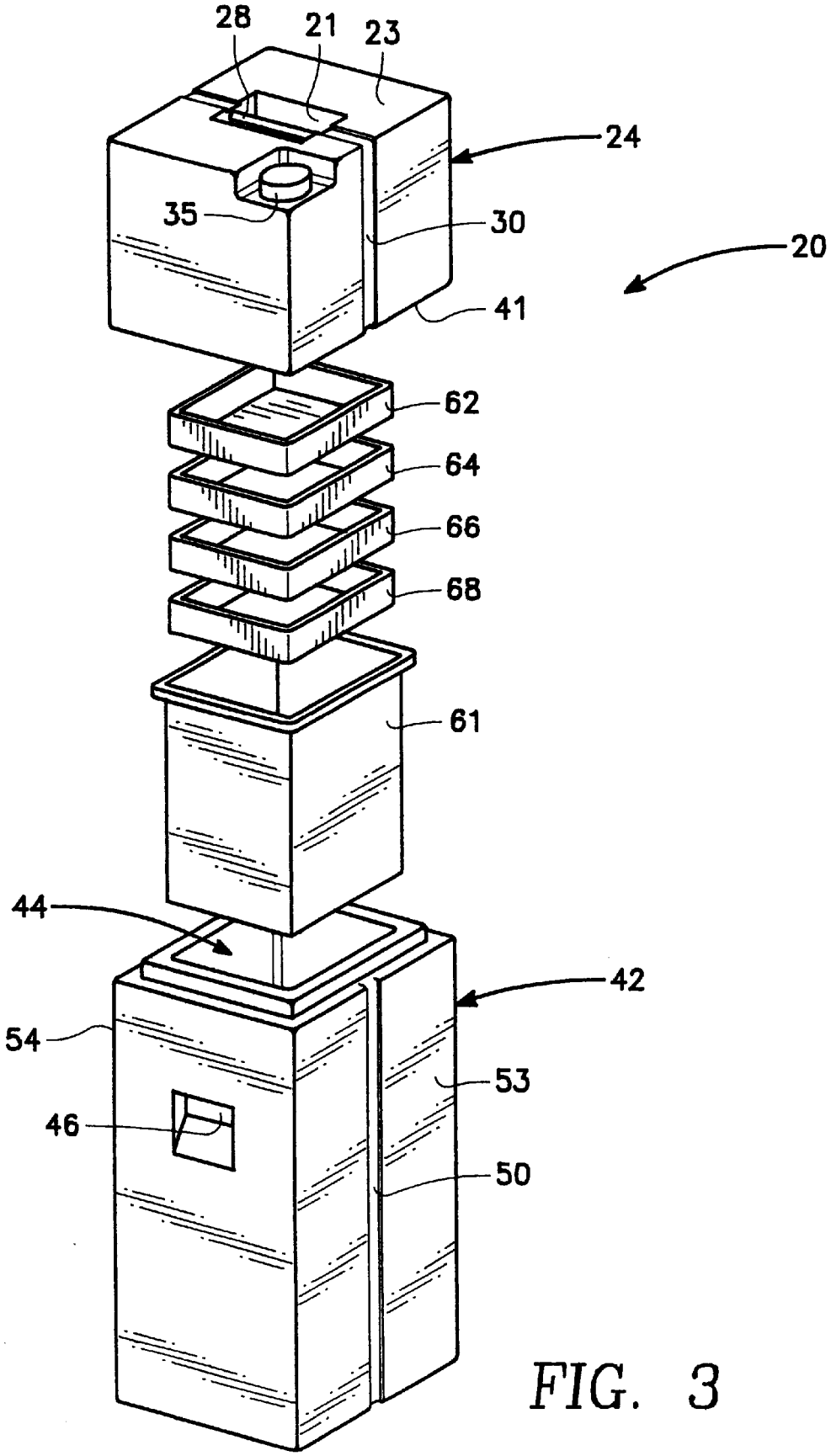
FIG. 3 is an exploded view illustrating the individual components of the modular combat load unit of FIG. 1.
Figure 4:
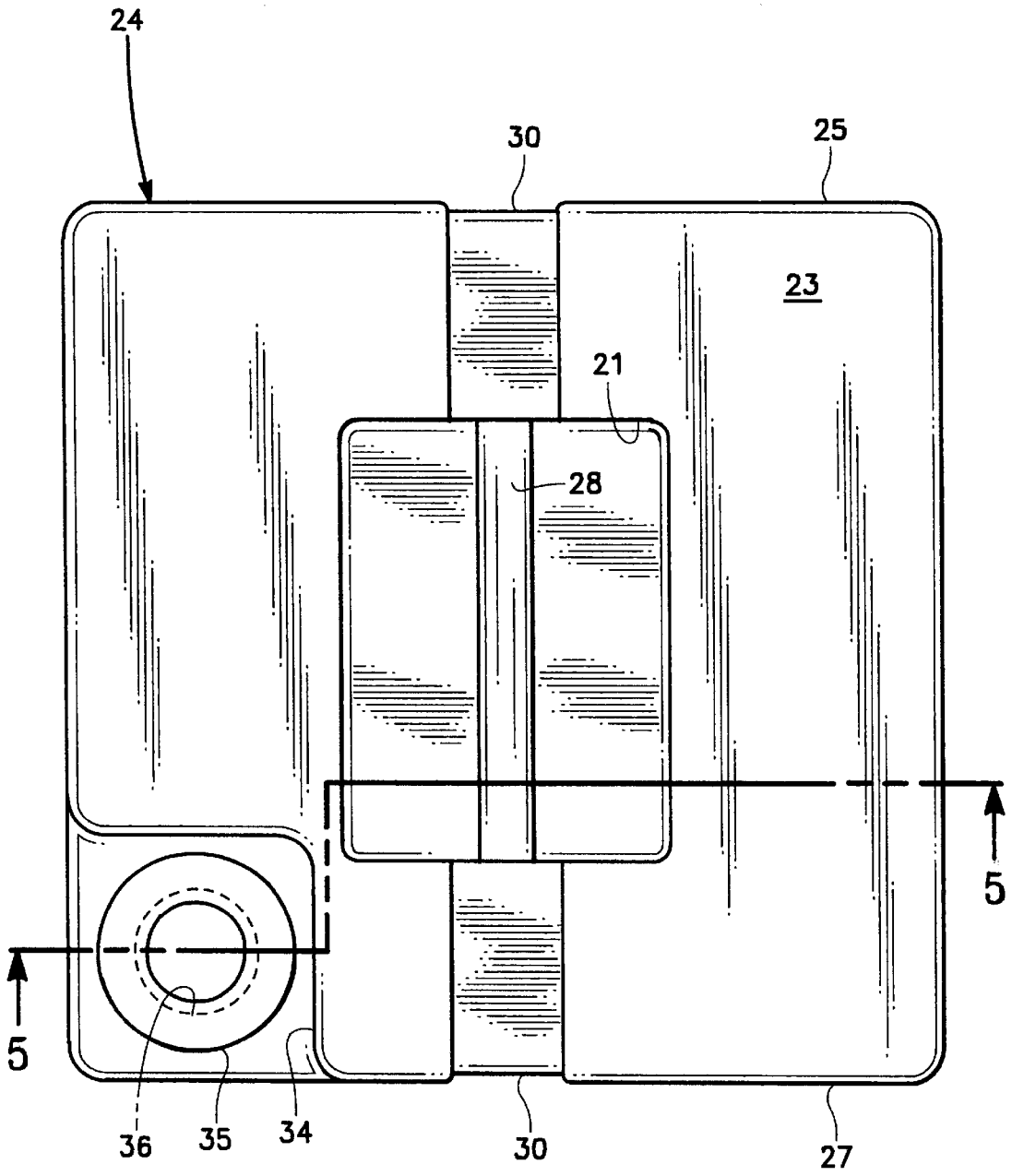
FIG. 4 is a top view of the water/fuel module for the modular combat load unit of FIG. 3.
Figure 5:
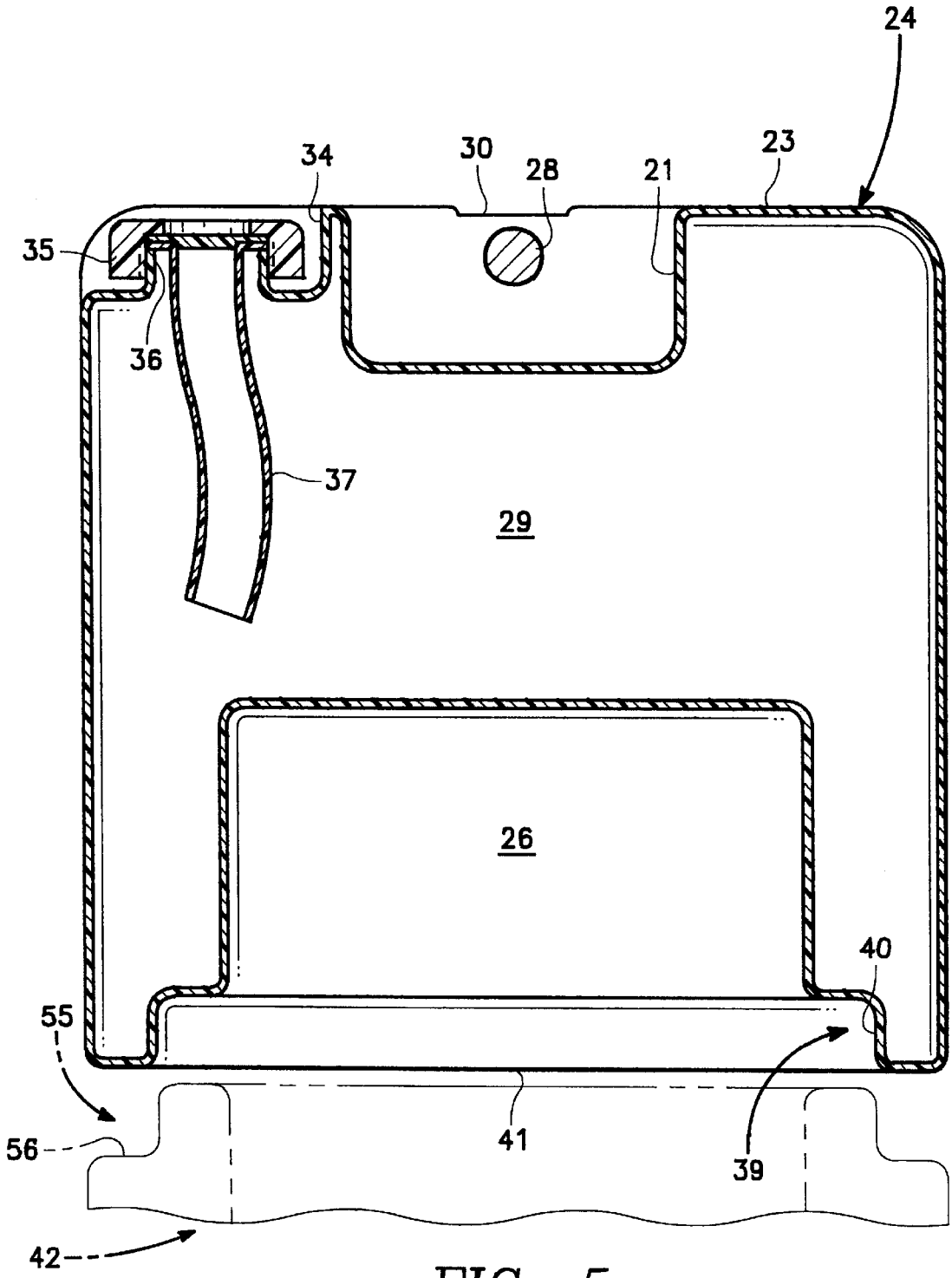
FIG. 5 is a side view, in partial section, of the water/fuel module for the modular combat load unit of FIG. 3.
Figure 6:
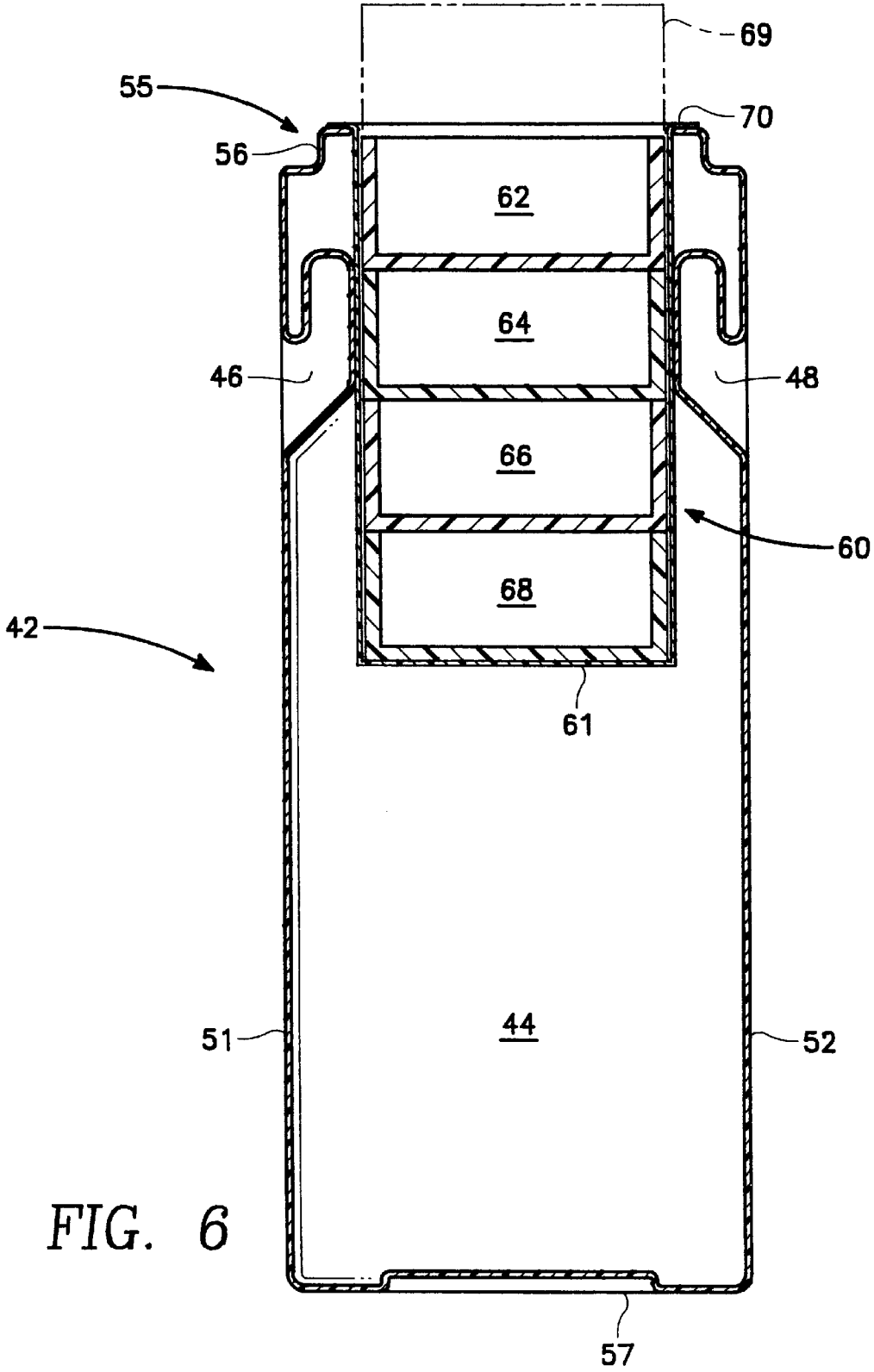
FIG. 6 is a side view, in partial section, of the mission requirements module of FIG. 3 and the field pack module assembly which is positioned within the interior of the mission requirements module.

Referring to FIGS. 1, 3 and 6, located at the bottom end 41 of module 24 is alignment/mating surface 39 around its periphery. Alignment/mating surface 39 has an indent 40 on the inner portion thereof which when correctly positioned aligns module 24 with mission requirements module 42.

The modular combat load unit 20 includes mission requirements module 42 which comprises the lower portion of unit 20. The interior 44 of mission requirements module 42 which forms a cavity may be used to store additional medical supplies, food and water, ammunition and other consumables used by military troops in a combat area. Mission requirements module 42 has overall dimensions of 12 inches long by 12 inches wide by 30 inches high. Mission requirements module 42 has a pair of handles 46 and 48 positioned respectively on opposite side walls 51 and 52 of module 42 in proximity to the upper end of module 42. Mission requirements module 42 also includes a centrally located one eight inch indent 50 which is identical to and aligns with the indent 30 of module 24. Indent 50 is also adapted to receive channel strap 32 which is used to secure water fuel module 24 to mission requirements module 42. Indent 50 runs across the bottom end 57 of mission requirements module 42 and is vertically positioned on opposite side walls 53 and 54 of module 42.

As shown in FIG. 3, the indent 50 is located on side walls 53 and 54 of module 42 which are perpendicular to side walls 51 and 52 of module 42 which has handles 46 and 48.

Located at the upper end of mission requirements module 42 is an alignment/mating surface 55 around its periphery. Alignment/mating surface 55 has an indent 56 located on the outer portion thereof which when correctly positioned aligns module 24 with module 42.

The modular combat load unit 20 also has a field pack module assembly 60 which is inserted or positioned within the cavity formed within interior 44 of mission requirements module 40. The field pack module assembly 60 includes a field pack tray 61 which is eight inches long by eight inches wide by about 14 inches high. The field pack tray 61 holds four field pack storage units 62, 64, 66 and 68 which are stacked on top of one another and fit within field pack tray 61. A fifth field pack storage unit 69 may be stacked on top of the four field pack storage units 62, 62, 66 and 68 contained within tray 61. Field pack storage unit 69 is positioned within the rectangular shaped wash basin 26 of module 24 when modular combat load units 20 is fully assembled.

The five field pack storage trays 62, 64, 66 and 68 are each approximately eight inches long by eight inches wide by 3.6 inches high.

Field pack storage unit 62 is adapted to hold food/rations sufficient to last a soldier one day in a combat environment and weighs about 4.18 lbs. The rations may be stored in plastic containers or cans or any other type of food container which fits within field pack storage unit 62.

Field pack storage unit 64 is adapted to hold about 1.0 gallon of drinking water which is also sufficient to last a soldier one day in a combat environment. The drinking water may be stored within individual plastic bottles or containers which fit within field pack storage unit 64.

Field pack storage unit 66 is adapted to store ammunition for use by a soldier in a combat environment and weighs about 3.31 lbs. The ammunition stored in field pack storage unit 66 may includes bullets for an M-16 rifle or a fifty caliber machine gun or hand grenades or other types of munitions used in a combat environment.

Field pack storage unit 68 is a general purpose storage unit which mat be used to store a medical kit or other medical supplies.

Field pack storage unit 69 is also a general purpose storage unit which may be used to store additional rations or water for use by a soldier in a combat environment.

Field pack tray 61 has a 13/16 inch lip 70 at its upper end which extends outward from the body of field pack tray 61. When modular combat load units 20 is fully assembled, lip 70 of tray 61 is sandwiched between mating surface 39 of module 24 and mating surface 55 of module 42. This, in turn, secures field pack tray 61 within the interior 44 of mission requirements module 42.

At this time it should be noted that field pack tray 61 may be modified to accommodate five field pack storage units. When modified to hold five field pack storage units the overall length about 3.5 inches. It should also be noted that field pack tray 61 may be modified to accommodate only three field pack storage units which would require that the overall length be decreased by about 3.5 inches.

It should also be noted that water/fuel module 24, mission requirements module 42, field pack tray 61 and field pack storage units 62, 64, 66, 68 and 69 may be fabricated from a plastic which is relatively easy to dispose by incineration or other disposal means.

Figure 7:
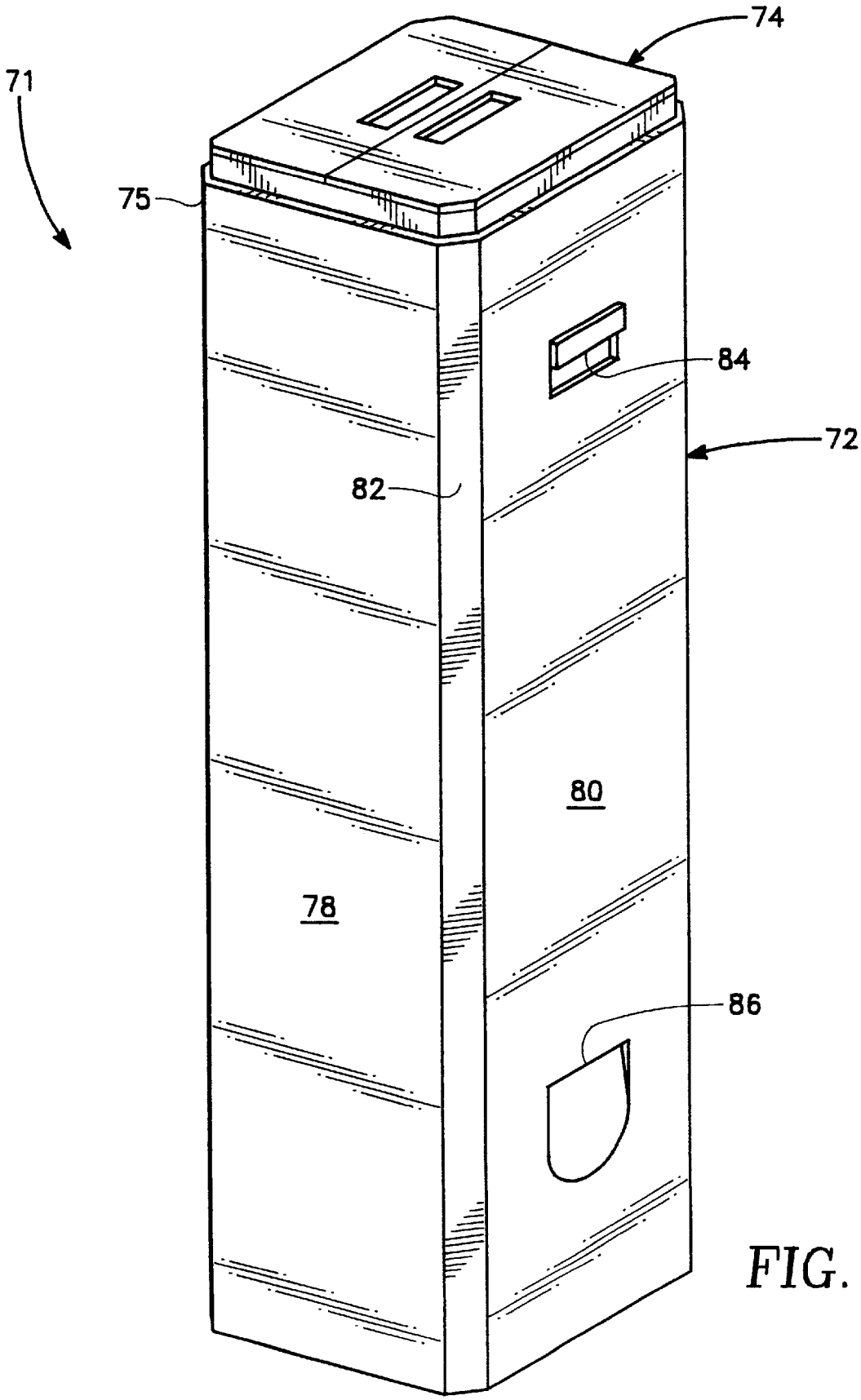
FIG. 7 is a perspective view illustrating a disposable modular combat load unit for storing consumable products for use by a soldier in a combat environment which constitutes a second embodiment of the present invention.
Figure 8:
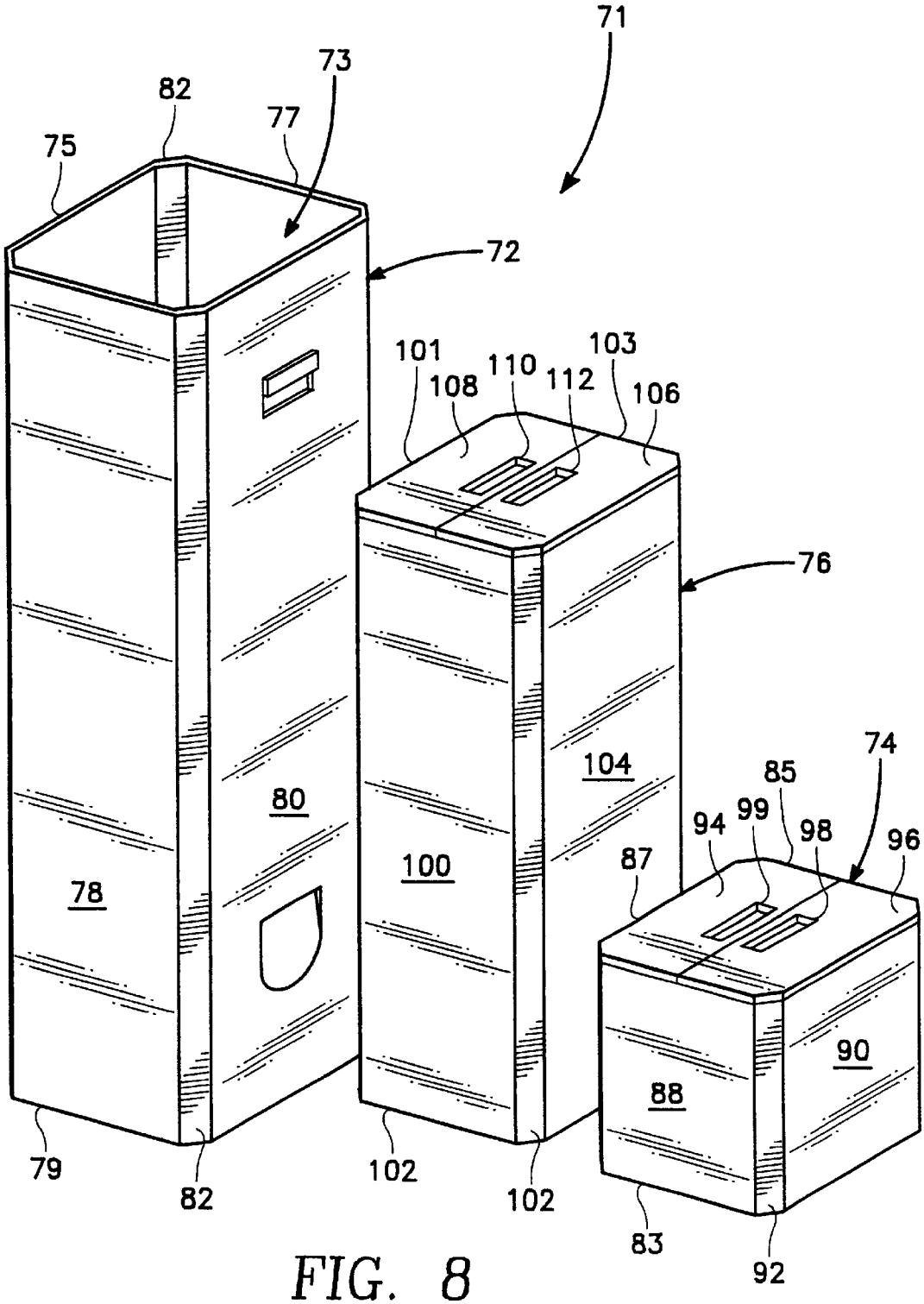
FIG. 8 is an exploded view illustrating the individual components of the disposable modular combat load unit of FIG. 7.
Figure 9:
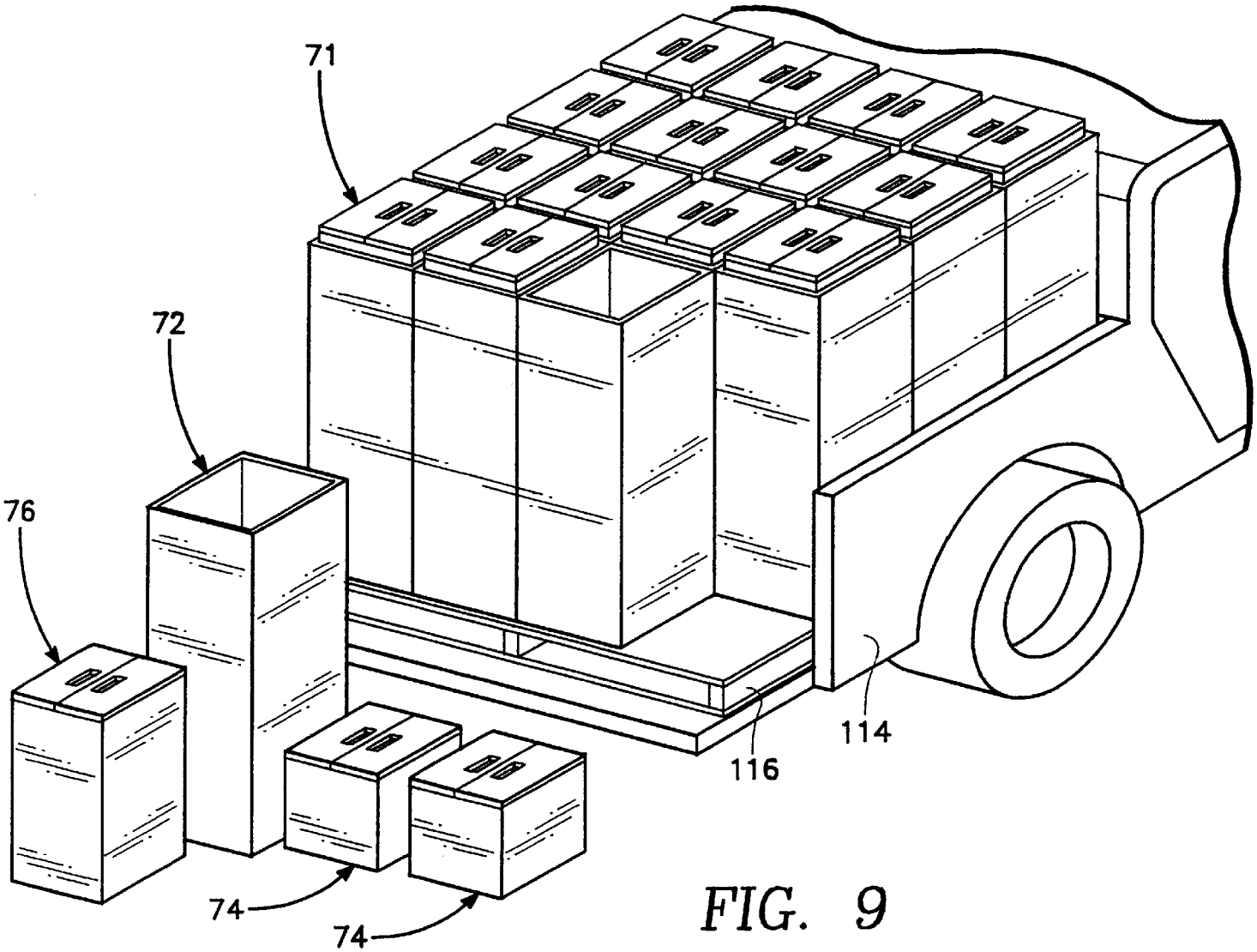
FIG. 9 depicts the disposable modular combat load unit of FIG. 7 being loaded onto pallets for transport by a vehicle to a combat zone.

Referring now to FIGS. 7, 8 and 9, there is shown a disposable modular combat load unit, designated generally by the reference numeral 71, which is environmentally friendly in that the unit is degradable over time or can be recycled to produce other products. The disposable modular combat load unit 71 includes a mission requirements unit load container 72 which is designed to hold a plurality of individual disposable combat modular storage units 74 and 76. Container 72 and storage units 74 and 76 are depicted in FIG. 8.

As shown in FIG. 9, the disposable modular combat load units 71 are loaded onto a pallet 116 for transportation to a combat zone by a military vehicle 114. The disposable modular combat load units 71 are then unloaded from pallet 116 when the military vehicle 114 are arrives the combat zone for use by military personnel engaged in combat and those individuals providing support the troops in combat. Sixteen of the disposable modular combat load units 71 are loaded onto a pallet 116 in the manner illustrated in FIG. 9.

Referring to FIGS. 8, 10, 11 and 12, the disposable modular combat load unit 71 includes a water/fuel module 120 which is designed to fit within an individual disposable combat modular storage unit 74 for transport to a combat zone. When used to carry water, the water/fuel module 120 of each unit 71 contains approximately 2.00 gallons of water for use by military personnel.

The water/fuel module 120 may be fabricated from a light weight, clear plastic or polymer when the module 120 is used to transport water to a combat environment. When used to carry fuel, module 120 is generally fabricated from a polymer which is opaque to light and which is designed for fuel transport. The water/fuel module 120 weighs about one pound when empty.

Figure 10:
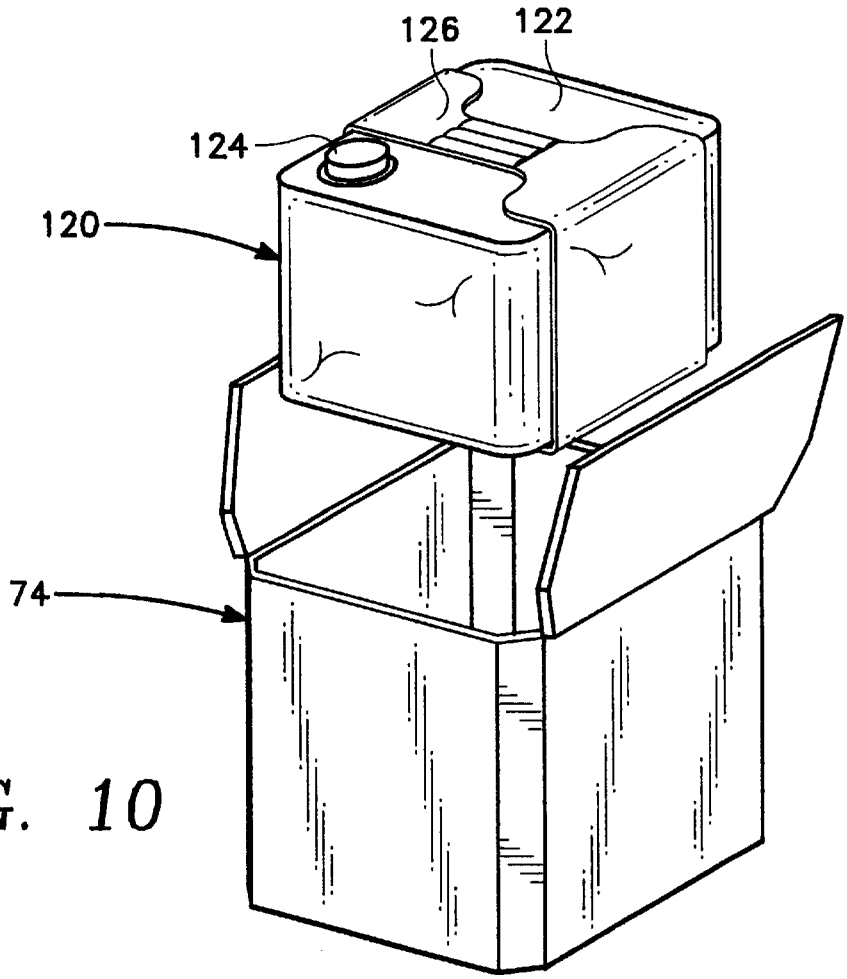
FIG. 10 illustrates an individual component unit of the disposable modular combat load unit of FIG. 7 having a collapsible storage container for storing a liquid such as water for use in a combat environment.
Figure 11:
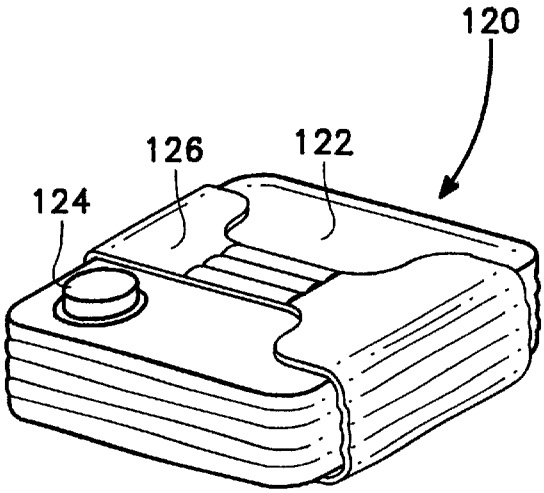
FIG. 11 illustrates the collapsible storage container of FIG. 10 when fully collapsed.
Figure 12:
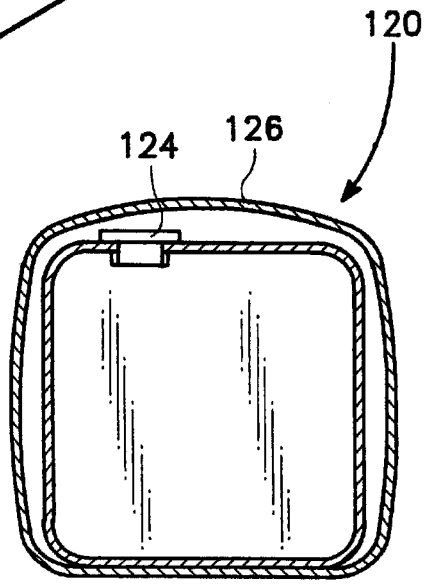
FIG. 12 is a sectional view depicting the collapsible storage container of FIG. 11.

The water/fuel module 120 is generally rectangular in shape and has overall dimensions of 10½" in length by 9¼" in width and a height of 7½". FIG. 10 depicts the water/fuel module 120 when filled with a liquid such as drinking water for military personnel or a fuel such as gasoline or diesel fuel for military vehicles.

The water/fuel module 120 has an upper surface 122 which includes a cap 124 in one corner thereof. The cap 124 may be a threaded cap or a pop off cap. Cap 124 when removed allows a user to fill the module 120 with a liquid or drain liquid from the water/fuel module 120. Cap 124 may also include a vent for pressure relief from pressure created by fuel storage within the water/fuel module 120.

The water/fuel module 120 also has a handle 126 which allows a user to carry the water/fuel module 120 from a first location to a second location after removal of the module 120 from disposable combat modular load unit 74.

The mission requirements unit load container 72 has a generally rectangular shaped base 79 and side walls 75, 77, 78 and 80 which extend vertically upward from the base 79 of container 72. Mission requirements unit load container 72 also has an open top and an interior 73. The base 79 of container 72 is 13" in length by 12 3/16" in width and the overall height of container 72 is 38 inches. The corners 82 between adjoining side walls are angled at approximately 45° to allow for rapid loading of the units 71 onto pallet 116 and rapid unloading of the units 71 from pallet 116. Rapid loading and unloading of the units 71 onto pallet 116 may about two minutes to ten minutes.

A user of the disposable modular combat load unit 71 can insert two storage units 74 and one storage unit 76 into the interior 73 of mission requirements unit load container 72 prior to loading unit 71 onto pallet 116 for transportation to a combat environment.

Each disposable combat modular storage unit 74 has a rectangular shaped base 83 and side walls 85, 87, 88 and 90 which extend vertically upward from the base 83 of storage unit 74. The base 83 of storage unit 74 is 11½" in length by 11 5/16" in width and the overall height of storage unit 74 is 9¾ inches. The corners 92 between adjoining side walls are angled at approximately 45° to allow for alignment and relatively easy of movement and insertion of disposable combat modular storage unit 74 into mission requirements unit load container 72 prior to transport to a combat zone.

The top of storage unit 74 has a pair of lids 94 and 96 which open about the center of unit 74 allowing access to the interior of storage unit 74 for storage of medical supplies, food and water, ammunition and other consumables used by military troops in a combat area. Each lid of storage unit 74 has a rectangular shaped opening 98 and 99 with the openings 98 and 99 being in proximity to one another to form a handle, that is the openings are about 2½ inches apart. The handle formed by openings 98 and 99 allows a user of disposable modular combat load unit 71 to remove storage unit 74 from mission requirements unit load container 72 and then carried to a desired location. An adhesive tape may be used to seal the lids 94 and 96 shut.

Each disposable combat modular storage unit 76 has a rectangular shaped base 102 and side walls 100, 101, 103, and 104 which extend vertically upward from the base 102 of storage unit 76. The base 102 of storage unit 76 is 11½" in length by 11 5/16" in width and the overall height of storage unit 76 is 19¾ inches. The corners 102 between adjoining side walls are angled at approximately 45° to allow for alignment and relatively easy insertion of disposable combat modular storage unit 76 into mission requirements unit load container 72 prior to transport to a combat zone.

The top of storage unit 76 has a pair of lids 106 and 108 which open about the center of unit 76 allowing access to the interior of storage unit 76 for storage of medical supplies, food and water, ammunition and other consumables used by military troops in a combat area. Each lid of storage unit 76 has a rectangular shaped opening 110 and 112 with the openings 110 and 112 being in proximity to one another to form a handle, that is the openings are about 2½ inches apart. The handle formed by openings 110 and 112 allows a user of disposable modular combat load unit 76 to remove storage unit 76 from mission requirements unit load container 72 and then carried to a desired location. An adhesive tape may be used to seal the lids 106 and 108 shut.

Referring to FIGS. 7 and 9, opposed side walls 75 and 80 of mission requirements unit load container 72 each have a rectangular shaped opening 83 which is positioned approximately 7½ inches from the top of container 72. The openings 84 in opposed side walls 75 and 80 function as handles for disposable modular combat load unit 71. The openings 84 of mission requirements unit load container 72 allow a user to load the disposable modular combat load units 71 onto a pallet 116 and remove the load units 71 from pallet 116.

Opposed side walls 75 and 80 of mission requirements unit load container 72 each have a generally rectangular shaped opening 86 which has a curved edge on one side and is positioned approximately 10¾ inches from the bottom of mission requirements unit load container 72. The openings 84 in opposed side walls 75 and 80 also function as handles for disposable modular combat load unit 71.

At this time it should be noted that the individual components of disposable modular combat load unit 71 including mission requirements unit load container 72 and disposable combat modular storage units 74 and 76 may have a camouflage exterior to avoid detection and blend within a combat environment.

At this time it should be noted that disposable modular combat load unit 71 and its individual components may be fabricated from card board or any other light weight disposable material.

From the foregoing, it may readily be seen that the present invention comprises a new, unique and exceedingly useful modular combat load system for transporting consumables to a combat environment which constitutes a considerable improvement over the known prior art. Many modifications and variations of the present invention are possible in light of the above teachings. It is to be understood that within the scope of the appended claims the invention may be practiced otherwise than as specifically described.

What is claimed is:

1. A modular combat load system for supplying soldiers within a military unit with mission critical consumable supplies in a combat environment, comprising:

(a) a plurality of modular combat load units stacked side by side on a pallet for transport to said combat environment by a military vehicle, each of said plurality of modular combat load units including a mission requirements unit load container and a plurality of combat modular storage units of varying storage capacity;

(b) said mission requirements unit load container having an interior adapted to receive said plurality of combat modular storage units and store said plurality of combat modular storage units therein, said mission requirements unit load container comprising:

(i) a top end having a generally rectangular shaped opening which allows access to the interior of said mission requirements unit load container;

(ii) an enclosed bottom end having a generally rectangular shape;

(iii) four side walls extending vertically upward from the enclosed bottom end of said mission requirements unit load container to the top end of said mission requirements unit load container, wherein adjoining side walls of said mission requirements unit load container are angled at approximately forty five degrees to allow for rapid loading of said modular combat load units onto said pallet and rapid unloading of said modular combat load units from said pallet;

(iv) a pair of rectangular shaped openings, one of said pair of rectangular shaped openings being positioned in one side wall of said four side walls and another of said pair of rectangular shaped openings being positioned in an opposed side wall of said four side walls, said pair of rectangular shaped openings in each of said mission requirements unit load container operating as handles allowing a user to load and unload said modular combat load units from said pallet; and (c) each one of said combat modular storage units having an interior adapted for storage of said mission critical consumable supplies therein, each one of said combat modular storage units comprising:

(i) an enclosed bottom end having a generally rectangular shape;

(ii) four side walls extending upper from the enclosed bottom end of said combat modular storage unit to a top end of said combat modular storage unit, wherein adjoining side walls of said combat modular storage unit are angled at approximately forty five degrees to align said combat modular storage unit with the interior of said mission requirements unit load container and to allow for insertion of said combat modular storage unit into the interior of said mission requirements unit load container; and (iii) the top end of said combat modular storage unit having a pair of lids which open about a center for the top end said combat modular storage unit allowing access to the interior of combat modular storage unit for storage said mission critical consumable supplies therein.

2. The modular combat load system of claim 1 wherein each of said plurality of modular combat load units including said mission requirements unit load container and said plurality of combat modular storage units are fabricated from a disposable material.

3. The modular combat load system of claim 1 wherein said disposable material comprises cardboard.

4. The modular combat load system of claim 1 wherein each lid of said pair of lids of said combat modular storage unit has a rectangular shaped opening, the rectangular shaped opening of one of said pair of lids being aligned with the rectangular shaped opening of the other of said pair of lids to form a handle which allows said user to remove said combat modular storage unit from the interior of said mission requirements unit load container.

5. The modular combat load system of claim 1 wherein the bottom end of said mission requirements unit load container is 13" in length by 12$\frac{3}{16}$" in width, said mission requirements unit load container having an overall height of 38 inches.

6. The modular combat load system of claim 1 wherein said plurality of combat modular storage units comprises first, second and third combat modular storage units.

7. The modular combat load system of claim 6 wherein the bottom end of said first combat modular storage unit and second combat modular storage unit is 11½" in length by 11⁵⁄₁₆" in width, said first combat modular storage unit and said second combat modular storage unit having an overall height of 9¾ inches.

8. The modular combat load system of claim 6 wherein the bottom end of said third combat modular storage unit is 11½" in length by 11⁵⁄₁₆" in width, said third combat modular storage unit having an overall height of 19¾ inches.

9. The modular combat load system of claim 6 wherein each of said first and second combat modular storage units is adapted to receive a collapsible water/fuel module which fits within the interior of said first and second combat modular storage units.

10. The modular combat load system of claim 9 wherein said collapsible water/fuel module is fabricated from a polymer which is opaque to light when said collapsible water/fuel module is used to carry fuel.

11. The modular combat load system of claim 9 wherein said collapsible water/fuel module is fabricated from a polymer which is transparent to light when said collapsible water/fuel module is used to carry water.

12. The modular combat load system of claim 6 wherein said mission requirements unit load container and said first, second and third combat modular storage units have a camouflage exterior to avoid detection and blend within said combat environment.

13. A modular combat load system for supplying soldiers within a military unit with mission critical consumable supplies in a combat environment, comprising:

(a) sixteen modular combat load units stacked side by side on a pallet for transport to said combat environment by a military vehicle, each of said sixteen modular combat load units including a mission requirements unit load container and first, second and third combat modular storage units of varying storage capacity;

(b) said mission requirements unit load container having an interior adapted to receive said first, second and third combat modular storage units and store said first, second and third combat modular storage units therein, said mission requirements unit load container comprising:

(i) a top end having a generally rectangular shaped opening which allows access to the interior of said mission requirements unit load container;

(ii) an enclosed bottom end having a generally rectangular shape;

(iii) four side walls extending vertically upward from the enclosed bottom end of said mission requirements unit load container to the top end of said mission requirements unit load container, wherein adjoining side walls of said mission requirements unit load container are angled at approximately forty five degrees to allow for rapid loading of said modular combat load units onto said pallet and rapid unloading of said modular combat load units from said pallet;

(iv) a pair of rectangular shaped openings, one of said pair of rectangular shaped openings being positioned in one side wall of said four side walls and another of said pair of rectangular shaped openings being positioned in an opposed side wall of said four side walls, said pair of rectangular shaped openings in each of said mission requirements unit load container operating as handles allowing a user to load and unload said modular combat load units from said pallet; and (c) each one of said first, second and third combat modular storage units having an interior adapted for storage of said mission critical consumable supplies therein, each one of said first, second and third combat modular storage units comprising:

(i) an enclosed bottom end having a generally rectangular shape;

(ii) four side walls extending upper from the enclosed bottom end of said combat modular storage unit to a top end of said combat modular storage unit, wherein adjoining side walls of said combat modular storage unit are angled at approximately forty five degrees to align said combat modular storage unit with the interior of said mission requirements unit load container and to allow for insertion of said combat modular storage unit into the interior of said mission requirements unit load container;

(iii) the top end of said combat modular storage unit having a pair of lids which open about a center for the top end said combat modular storage unit allowing access to the interior of combat modular storage unit for storage said mission critical consumable supplies therein; and (d) at least one of said first, second and third being adapted to receive and have stored therein a collapsible water/fuel module for transport of fuel and water to said combat environment.

14. The modular combat load system of claim 13 wherein said collapsible water/fuel module is fabricated from a polymer which is opaque to light when said collapsible water/fuel module is used to carry fuel.

15. The modular combat load system of claim 13 wherein said collapsible water/fuel module is fabricated from a polymer which is transparent to light when said collapsible water/fuel module is used to carry water.

16. The modular combat load system of claim 13 wherein the bottom end of said mission requirements unit load container is 13" in length by 12³⁄₁₆" in width, said mission requirements unit load container having an overall height of 38 inches.

17. The modular combat load system of claim 13 wherein the bottom end of said first combat modular storage unit and second combat modular storage unit is 11½" in length by 11⁵⁄₁₆" in width, said first combat modular storage unit and said second combat modular storage unit having an overall height of 9¾ inches.

18. The modular combat load system of claim 13 wherein the bottom end of said third combat modular storage unit is 11½" in length by 11⁵⁄₁₆" in width, said third combat modular storage unit having an overall height of 19¾ inches.

19. The modular combat load system of claim 13 wherein each lid of said pair of lids of said first, second and third combat modular storage unit has a rectangular shaped opening, the rectangular shaped opening of one of said pair of lids being aligned with the rectangular shaped opening of the other of said pair of lids to form a handle which allows said user to remove said first, second and third combat modular storage unit from the interior of said mission requirements unit load container.

20. The modular combat load system of claim 13 wherein said mission requirements unit load container and said first, second and third combat modular storage units have a camouflage exterior to avoid detection and blend within said combat environment.

* * * * *